US008720726B2

(12) United States Patent
Salinas

(10) Patent No.: US 8,720,726 B2
(45) Date of Patent: May 13, 2014

(54) ONE-PIECE LID FOR CARTONS

(71) Applicant: Jose Rodrigo Oliva Salinas, Mexico (MX)

(72) Inventor: Jose Rodrigo Oliva Salinas, Mexico (MX)

( * ) Notice: Subject to any disclaimer, the term of this patent is extended or adjusted under 35 U.S.C. 154(b) by 6 days.

(21) Appl. No.: 13/630,337

(22) Filed: Sep. 28, 2012

(65) Prior Publication Data

US 2013/0146598 A1 Jun. 13, 2013

(30) Foreign Application Priority Data

Sep. 30, 2011 (MX) ..... MX/a/2011/010313

(51) Int. Cl.
*B65D 43/16* (2006.01)

(52) U.S. Cl.
USPC ..... 220/269; 220/268; 220/258.5; 220/258.3; 220/258.1; 222/541.1; 229/125.17; 229/125.14; 229/125.11; 229/125.09

(58) Field of Classification Search
CPC ..... B65D 43/00; B65D 43/16; B65D 43/169; B65D 5/6697; B65D 5/727; B65D 5/747
USPC ..... 220/258.1, 258.3–258.5, 259.1, 220/265–269; 222/83, 541.1–541.6, 544, 222/556–557; 229/125.09, 125.11, 229/125.14–125.15, 125.17
See application file for complete search history.

(56) References Cited

U.S. PATENT DOCUMENTS

| | | | | |
|---|---|---|---|---|
| 2,676,744 | A | 4/1954 | Baselt | |
| 3,018,204 | A * | 1/1962 | Bice | 149/19.9 |
| 3,421,654 | A * | 1/1969 | Hexel | 220/254.3 |
| 4,453,666 | A * | 6/1984 | Gordon | 229/102 |
| 4,669,640 | A * | 6/1987 | Ando et al. | 222/541.5 |
| 4,795,065 | A * | 1/1989 | Ashizawa et al. | 222/541.5 |
| 4,858,793 | A * | 8/1989 | Stone | 222/541.5 |
| 4,895,298 | A * | 1/1990 | Reil | 229/125.01 |
| 4,919,313 | A * | 4/1990 | O'Brien | 229/125.08 |
| 4,930,682 | A * | 6/1990 | Gordon et al. | 229/123.3 |
| 5,101,999 | A * | 4/1992 | Robichaud et al. | 220/258.4 |
| 5,193,722 | A | 3/1993 | Groya et al. | |
| 5,199,618 | A * | 4/1993 | Reil et al. | 222/541.5 |
| 5,509,585 | A * | 4/1996 | Mock et al. | 222/541.1 |
| 5,657,894 | A * | 8/1997 | Bowen | 220/837 |
| D385,791 | S * | 11/1997 | Forsyth et al. | D9/447 |
| 5,894,950 | A | 4/1999 | Kick | |
| 5,927,535 | A | 7/1999 | Goth | |
| 5,934,496 | A | 8/1999 | Mogard et al. | |

(Continued)

FOREIGN PATENT DOCUMENTS

| | | |
|---|---|---|
| CA | 2612843 | 1/2009 |
| EP | 0658480 | 6/1995 |

(Continued)

*Primary Examiner* — Mickey Yu
*Assistant Examiner* — Brijesh V. Patel
(74) *Attorney, Agent, or Firm* — Welsh Flaxman & Gitler LLC

(57) ABSTRACT

A one-piece or monolithic body flat plastic lid for carton packages with thin walls and membrane or a web breaking under pressure, with a semicircular skirt provided with rectangular shaped entrance housing and locked to a closing and opening pivoting tab, joined to the border of a pouring orifice by means of a rupture horizontal perimeter membrane and a vertical breaking or tearing by means of pressure exerted in the vertical or transversal direction to the surface of the tab, which is locked by means of a hinge line to a transverse wall making the rectangular channel.

12 Claims, 5 Drawing Sheets

(56) References Cited

U.S. PATENT DOCUMENTS

| | | | | |
|---|---|---|---|---|
| 6,041,968 | A * | 3/2000 | Weiteder | 222/83 |
| 6,079,618 | A * | 6/2000 | Hedberg et al. | 229/125.15 |
| 6,131,804 | A * | 10/2000 | Julian | 229/125.09 |
| 6,164,503 | A * | 12/2000 | Forsyth et al. | 222/556 |
| 6,206,221 | B1 * | 3/2001 | Bando et al. | 220/254.5 |
| 6,216,905 | B1 | 4/2001 | Mogard et al. | |
| 6,257,449 | B1 * | 7/2001 | Baerenwald | 222/83 |
| 6,484,929 | B2 * | 11/2002 | Sumpmann et al. | 229/125.09 |
| 6,536,627 | B1 * | 3/2003 | Benoit-Gonin et al. | 222/83 |
| 2004/0026286 | A1 | 2/2004 | Ramsey | |
| 2005/0242112 | A1 * | 11/2005 | Leuenberger et al. | 222/83 |
| 2006/0163188 | A1 | 7/2006 | Lagler | |
| 2007/0175909 | A1 * | 8/2007 | Solowiejko | 220/826 |
| 2007/0262078 | A1 | 11/2007 | Sheffler et al. | |
| 2010/0051574 | A1 * | 3/2010 | Soehnlen et al. | 215/235 |
| 2010/0140266 | A1 * | 6/2010 | Lohrman et al. | 220/254.3 |

FOREIGN PATENT DOCUMENTS

| | | |
|---|---|---|
| MX | 2008013812 | 11/2008 |
| WO | WO0107329 | 2/2001 |
| WO | WO2007015648 | 2/2007 |
| WO | WO2008141162 | 11/2008 |
| WO | WO2011085011 | 7/2011 |

* cited by examiner

ONE-PIECE LID FOR CARTONS

FIELD OF THE INVENTION

The present invention relates to a carton package lid for fluid, solid or liquid materials, particularly to an injection made one piece lid to be placed in the pouring orifice of a carton package or recipient.

BACKGROUND OF THE INVENTION

Most lids are made of plastic material or produced by injection molding or thermoforming, some of which provided with several pieces assembled to form the closure, most of them offer a great resistance to undesirable humidity, dust or other polluting agents to the interior of the container. The closures or lids of this type are flat with a tab that rises with the fingers to allow free access inside the container, this lid seal prevents the opening to dispense and it is possible to close it again when the consumer so requires; other embodiments are threaded rounded for bottle type containers, some with a flat base with a wall or skirt added provided with additional threads with a hinged folding lid.

The containers used as recipients are made with cardboard walls with particular features in which internal face have adhered a thin film plastic, flexible, insulating that creates a seal or barrier to preserve the product contained inside the recipient. The container has a section or sometimes an upper face with an stamped opening in the cardboard without reaching the seal, through this opening the product confined within the container will flow. The lids are of different models, shapes and sizes, there are flat, threaded lids, etc., also there are with protective tab and an internal seal, two pieces flat in handle mechanisms; there are with three components requiring a final assembly, even with a threaded body, a threaded lid provided with perimeter elements, with inclined planar edges that when turned drive an internal bushing with cutting elements in the form of sharp edges that tear the seal of the container at the time of turning the threaded lid in the event of opening the groove of the recipient.

The flat plastic lids provided with protective tabs and a seal in the form of aluminum tape adhered to the internal lining of the container. When opening the tab, the aluminum seal is exposed with a free end to be taken with the fingers to pull it and remove along with breaking the internal lining of the container, in this case and most of the times, it is seldom practical to take with the fingers the end of the aluminum seal, since such action is difficult and contaminates the pouring port of the contents of the container.

The plastic lids with lever mechanisms for tearing of the internal lining, in this case a base body adhered to the vicinity of the opening of the cardboard that is the support of the container, a flat extended body located on said opening and coupled to horizontal protrusions acting as spin axis, when the back end rises, such extended body turns and the front end presses the stamped cardboard in the opening of the container breaking such die cut and internal lining allowing air intake and the exit of the contents, after the opening when the extended body turns in the opposite sense, the opening of the container remains closed and avoids deliberate spill of the contents.

The three-components plastic lids, in this case, comprise a cylindrical body and flat base, a threaded lid and an internal cylinder with the inferior edge provided with sharp edges that when turned break the seal of the container; the cylindrical body together with the base has a threaded external surface; the threaded lid comprises concentric edges with inclined plane borders, when turning said lid, drives downwards to the internal cylinder in a downward turn that causes the rupture of the seal of the container to allow pouring the internal contents.

Until now the mentioned lids comprise two or more components and normally are required two or more operations to assemble them or to open the containers.

In the case of the conventional flat lids the injection mold houses the body and lid, but they appear open, requiring a large space in the mold for the manufacture; in other cases several molds are required since the lid is formed of several pieces that back are assembled, generally these lids are robust in components and extend the curing time of, reducing consequently the productivity of the mold and the plastic injection machine. The lids of film or aluminum foil covering the opening of the seal have the disadvantage of difficult operation to grasp with the fingers the end of this aluminum film in an opening with very reduced space, with the possible consequence of contamination of the dispensing channel.

Examples of the above mentioned lids exist in the state of the art, like for example:

WO2011085011, published on Jul. 14, 2011, inventor Herald Coy M. et al, describes a several pieces round closure with a lid provided with hinge adapted for the pouring spout of a threaded container; the closure has a round pouring channel at the center acting as a sucker for the mouth of the consumer, the lid with hinge protects this sucker against the contamination and deliberate spill of the content of the container.

WO2008141162, published on Nov. 20, 2008, inventor Lohrman Richard et al., describes a closure made of a single piece with an skirt of round body in which top face has an pouring orifice protected by a folding lid provided with a hinge allowing to open and close the pouring orifice, the lid with hinge has the form of a rhombus with rounded vertices and a perimeter protuberance coupling in the form of the pouring orifice, such protuberance and the pouring orifice perimeter having edges allowing the closure with a click of the occlusion elements.

Mexican Patent Application MX2008013812, published on Nov. 12, 2008, inventor White Pey Max et al., describes a bottle closure with a threadable round body provided with a lid adhered to the top edge of the body by means of a membrane working with hinge, such lid provided with a seal element for the pouring orifice and with a top introduced in a groove corresponding to the closure to maintain together the lid to the round body.

Canadian patent CA2612843, published Jan. 11, 2009, inventor Dolan Thomas J. et al., describes a round closure with a cover lid divided in two side sections and a central provided with hinges that allows them to rise and to allow the exit the contents of the container, or by means of a groove or by means of a plurality of orifices, even can turn the whole lid to leave open the orifices and the groove.

U.S. 2007262078, published on Nov. 15, 2007, inventor Sheller Robert J. et al., describes a closure for pouring granulated substances, provided with a lid with hinge that does not allow the entrance of humidity and the exit of contents. The closure has a circular body and provided with a thread matching the mouth of the container, the lid with hinge provided with two lock elements that avoid deliberate opening thereof.

WO2007015648, published on Feb. 8, 2007, inventor Noonan Michael Patrick, describes a round closure with a skirt and a lid provided with a hinge and an stop element located in diametrically opposed point thereof, the closure is molded in one piece in the closed position and provided with a perimeter membrane that breaks at opening the lid, after the opening it can be closed again and is locked by means of a perimeter rib of the lid that hooks in another perimeter rib of the skirt. The complete closure is fixed to a container by means of adhesive to the base of the skirt.

U.S. 2006163188, published on Jul. 27, 2006, inventor Lagler Louis, describes a round closure provided with an inferior body and a top lid molded in a closed position, components joined by means of a fragile perimeter membrane and another one of trapezoidal shape that works as hinge of the lid.

U.S. 2004026286, inventor Ramsey Christopher Paul, describes a closure for carton packages provided with a base and flat lids of substantially rectangular form with a hinge, the base defines an orifice and pouring lip fixed to the container around the provided pouring orifice thereof, the lid provided with a ring coupling the internal wall of the pouring lip to provide hermetic closure.

U.S. Pat. No. 6216905, published on Apr. 17, 2001, inventor Mogard Jens et al., describes a SINGLE-piece closure with a body and a round lid joined together by hinge means, the lid provided with a round structure to push coupling the outside of the round body to provide the closure and avoid the spill of the contents of the container.

WO 0107329, filed Feb. 1, 2001, inventor Kieser Wolfgang et al., describes flat base closure and lid, the base is adhered to the container by means of adhesive; the lid can turn in an end by means of a hinge that causes the occlusion of the pouring orifice of the base to close after opening.

U.S. Pat. No. 5934496, published Aug. 10, 1999, describes a SINGLE-piece molded closure comprising a flat round base provided with a circular skirt and a hinged lid that allows the closure after initial opening; this lid is placed in the vicinity of the pouring orifice of a carton package, or flat face, the base adheres to the container by means of adhesive and contains a guide bolt for the alignment thereof in the container.

U.S. Pat. No. 5,927,535, published Jul. 27, 1999, inventor Goth Thomas P., describes a round pouring closure with an skirt and a pouring opening covering almost the whole top face, the opening is covered with a lid having an lower surface, a top and a hinge to make it work like a tab closing and opening the pouring orifice.

U.S. Pat. No. 5,894,950, published Apr. 20, 1999, inventor Kick James, describes a ONE-piece closure provided with a groove and lid thereof with a hinge which allows closing the groove, both elements are molded simultaneously and the groove and lid are separated by means of a thin membrane or web5 that is easily teared to allow opening and closing of the lid, the hinge formed by a seam line between the back wall of the groove and the lid that turns downwards or within the container.

EP0658480, published Jun. 21, 1995, inventor Hedberg Peter, describes a substantially rectangular closure adhered to a carton package, the closure provided with a base that contains an pouring orifice matching the orifice of the container; a metallic seal film within the base to cover the pouring orifice and a hinged lid that turns on the internal edge of the one of the walls of the base, allowing closing and opening after initial opening.

U.S. Pat. No. 5193722, published Mar. 16, 1993, inventor Groya Robert J., and et al., describes a closure with a round base and a hinged lid which allows to raise and pour contents of the container, said lid of only a section of the top face, rises a small angle in relation to said face allowing the back closure to be located in a position aligned with the surface of the face.

U.S. 2676744, published Apr. 27, 1954, inventor Frederick C. Baselt, describes a flat closure with a base and folding lid that allows to voluntarily open and close the carton package and of rectangular shape.

BRIEF DESCRIPTION OF THE INVENTION

It is an object of the present invention to provide a ONE-piece lid for carton packages molded in closed position.

It is another object of the present invention to provide a ONE-piece lid for carton packages not requiring assembly operations not having loose pieces.

It is also an object of the present invention to provide a ONE-piece lid for carton packages that use the minimum material being their walls thin.

It is still an object of the present invention to provide a ONE-piece lid for carton packages that provide a hermetic closure, once opened the closure is not hermetic.

It is an object of the present invention to provide a ONE-piece lid for carton packages of lower cost of manufacture since when using less material, the injection mold is of greater capacity in a size similar to the one of other lids; the cycle is smaller and it does not require of assembly operations.

It is also an object of the present invention to provide simple opening, ONE-piece lid for carton packages, which is pressed to tear the hermetic seal of the union between the body and the tab.

It is still an object of the present invention to provide a ONE-piece lid for carton package which closure, after the initial opening is made when pressing the tab to its lowest position.

It is even an object of the present invention to provide a ONE-piece lid for carton packages in which the opening in which flow the contents of the container has not been touched previously by the fingers of the user, therefore without possibility of contamination of the contents.

It is still an object of the present invention to provide a ONE-piece lid for carton packages in which its design allows to easily see the previous tearing of some of them.

An object of the present invention is another one to provide a ONE-piece lid for carton packages in which the tab works as closure, joined to the lid by means of a thin edge that fractures when pressing, allowing opening and free flow of the contents of the carton package.

It is still an object of the present invention to provide a ONE-piece lid for carton packages locked to the carton package by means of induction.

Also an object of the present invention is to provide a ONE-piece lid for carton packages having straight edge sections in the perimeter of the base for location of the lid in the vicinity of the pouring orifice of the container.

It is also an object of the present invention to provide a ONE-piece lid for appropriate carton packages for viscous products that do not require air tightness like detergents, soaps, creams, oils; or powders and granulates such as sugar, agrochemicals, milk, cereals.

DETAILED DESCRIPTION OF THE INVENTION

Figure 1:
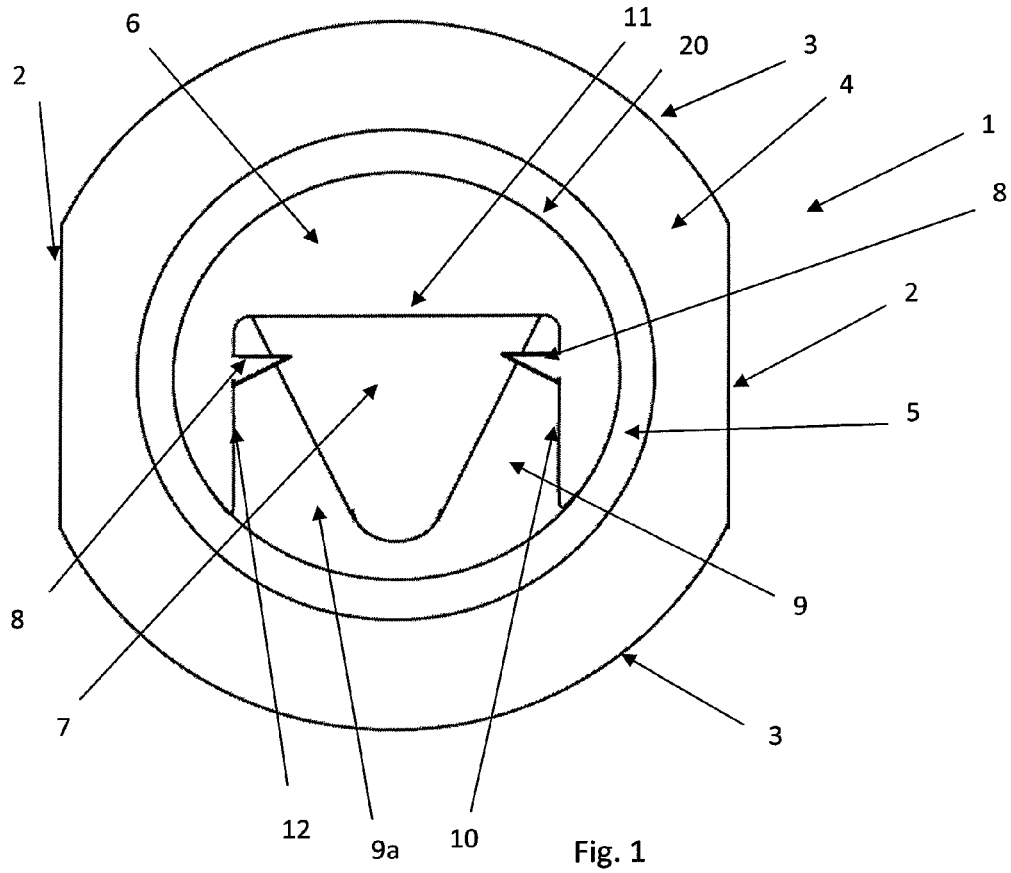
FIG. 1, is a top view of the one-piece lid for carton packages of the present application.

The one-piece or monolithic plastic lid located on the pouring opening of a container of fluids, said lid is locked in the container by means of heat and pressure, called process of induction in the state of the art.

When the consumer wishes to have access to the product within the container, the tab is pressed or pushed downwards to break the perimeter seal existing between the edge of the tab and the edge of the opening defined in a flat surface defined within a semicircular skirt with a back flat section and a frontal rectangular section, then the tab is pulled up to allow the flow of the contents, the tab is raised and turned on a back membrane joined to the end of an associated back cross-sectional wall to the top face of the skirt. This membrane between the back wall and the tab of a thickness that is not broken with the push downwards and merely weakens and works as hinge for the opening and closing of the tab. Subsequent to the opening event, the contents can flow towards the consumer and if the contents is not exhausted, the lid can be closed again; but no longer having a hermetic seal, it will avoid the spill of the inner contents of the container. The container is made generally of cardboard on which is adhered the base of the object of the present invention.

When the tab is closed it prevents the entrance and exit of humidity and other undesirable polluting agents. With this lid, tampering is avoided which contaminate the pouring orifice of the beverage. The container suitable of the present invention generally comprises a body made with five layers that consist of polyethylene, cardboard, and aluminum wrapping and barrier means, the bottom and walls are of the same material, the plastic lid used in this type of containers is made of plastic injection and thin walls.

The lid of the present invention is a member with thin walls plastic one-piece body, the raw material used is polyethylene or polypropylene or another resin, the one-piece lid is provided with an associated round flat base with two straight sections, from said base a contiguous step with a perimeter round wall back in continuous emerges with the sides and opened to the front which serves as support to hold the hinge that allows the opening of the tab being teared from the perimeter top edge of the extended body of the skirt. The closure tab is joined to the edge of an internal back wall that along with two side vertical walls form the pouring space of the substance and defines the location of the tab, the hermetic seam is carried out by means of a thin membrane that joins these perimeter edges of the tab with a flat surface provided with pouring orifice, this orifice has the lines of breaking or joining membranes between the tab and edges of the orifice, the inferior perimeter edge of the tab enter beyond the top edge of the orifice providing a closure between both pieces avoiding the involuntary spill. The membrane joining the back end of the tab and the top edge of the frontal face of the cross-sectional wall provides a hinge that allows the opening and closing movement of the tab.

Opening Procedure.

To open the lid, the top face of the tab is pressed downwards with the thumb or in a direction towards the inside of the container, with this action tearing the perimeter thin film between the tab and the edge of the orifice; then the tab is raised by means of its front end rising beyond the space defined by the side ends of the skirt, generating with this design a rim by means of which this tab can be raised with the finger; when raising the latter opens the orifice or channel that will allow the flow of the product towards the outside from the interior of the container.

The lid and consequently the container, once it is opened can dispense product, can be returned to close again downwards pressing with the fingers the tab in direction, until arriving at its original position, being necessary to exert additional pressure to jump a top towards the interior of the pouring orifice being generated a click, this position provides a suitable but non-hermetic closure that allows the conservation of the product within the container. To open again the tab is raised overcoming the interference that retains it in closure position within the container.

The manufacture process of the lid is the one of plastic injection where the use of the mold is optimized, that by the design of a one-piece occupies little space when united being the tab to the cross-sectional wall and its extensions, allowing with it that in the injection mold has a greater number of cavities in comparison with the molds of the state of the art since it makes the opened body and the lid, in other cases of lids or even close require several molds, because the lids are formed of independent pieces that are assembled requiring a back step for he himself; the lid of the present invention does not require of joint process since it is a monolithic piece that forms in a single operation of injection, the walls are thin in comparison with those of the state of the art, reason why it derives in a considerable saving of raw material, also in time because the cured process of injection and is very short increasing with it the capacity of production of the mold and machine of injection. The lids of the state of the art require of greater amount of raw material by the robustness of their components and the amount of pieces that form them. A very important characteristic of the lid of the present application, is that the pouring channel of its contents is not touched with the fingers reason why in the opening they stay a high level of asepsia.

For a more clear description of the novelty of the invention the annexed figures will be used, FIG. 1 is a top view of the lid or closure (1) of the present invention with a flat base (4) divided in sections, two circular ones (3) and two straight parallel (2) diametrically opposed that serve to provide the direction of the lid for the installation in the carton package, this direction facilitates the exit of the product contained in the packing. The locking of the lid is made by means of the induction process that is a general practice in the fixation of lids for the carton packages, this process consists of the application of pressure and heat in the area of the base (4) of the lid, in the radial direction and inwards of minor radius that the base follows a step circumferential (5) that elevates the level of location of the pouring orifice located in a horizontal flat surface (9*a*) located in a central frontal housing of rectangular shape (9) defined by three vertical walls that form a rectangular cavity where a tab lodges, walls (10, 11 and 12) within the round body of an skirt (20) of smaller diameter than the circumferential step that works as wall of retention of a tab and lids the side back sections and with the monolithic closure of the present application, This skirt (20) has a flat top back horizontal surface (6) that limits the edges of the vertical walls (10, 11, 12) within which is housed the pouring orifice and the tab (7); the top edge of the side vertical walls, each one has a flexible rim for the retention of the tab (7) in its opened position, that is to say, these rims (8) work as a stop to avoid the deliberate closure of the tab when it is in the position of complete opening; the top edge of the cross-sectional vertical wall (11) has a thin membrane or flexible line that works as hinge and allows the turn of the tab (7). FIG. 1, presents the closure of the present invention in its correct position of use on the range of the contents of the carton container. The skirt (20) of smaller diameter than the circumferential step provides protection to him to the tab against deliberate break that allows the spillage of the contents.

For locking the lid in the carton package, the lids or closures that are in bulk in a box are deposited in a container connected to an guide channel in which they are aligned due to the straight sections of the base, the guide places the lid right above and in the vicinity of the pouring orifice of the carton package, soon by means of the application of instantaneous heat and pressure in the area of the flat base the lid is attached to the carton package.

Figure 2:
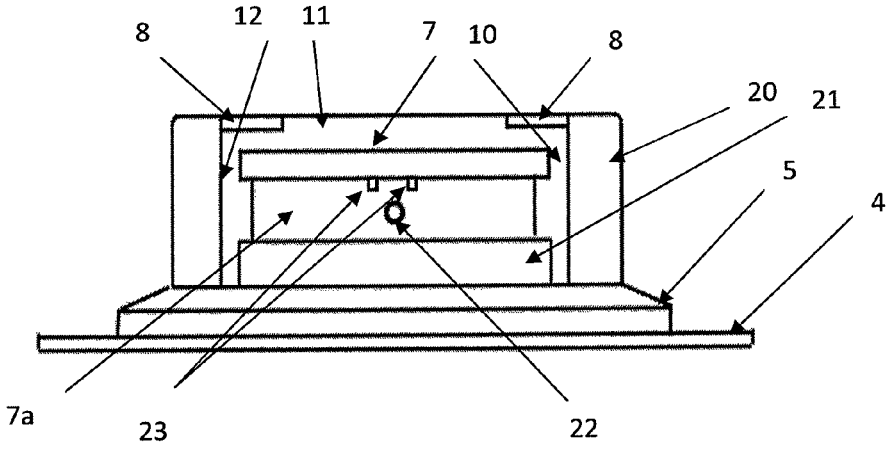
FIG. 2, is a frontal view of the one-piece lid for carton packages of the present application.

FIG. 2, is a front view of the lid or closure of the present invention that shows the base (4) locked to the carton package. the step (5) that elevates the level of the pouring orifice and closure by means of the tab (7) provided in the frontal section with two restriction elements or stops which limit displacement towards the interior of the pouring orifice, in effect, the tab stop (23) that does not allow that the same to go beyond when the tab stop (23) makes contact with the top edge of the frontal pouring wall (21); the stop (22) works as retention lock of the back closure position after initial opening, this is when the container still has product, the stop (22) goes beyond the frontal top edge of the pouring orifice or exit and retains the tab in non-hermetic closure position; but suitable to avoid the deliberate spill. Also are shown the vertical walls (10, 11, 12) that define a front compartment of rectangular shape where a tab (7) of substantially triangular form with the cleared frontal vertex lodges and that is monolithically attached at the border of the pouring orifice. attached by means of horizontal tear line and to the back cross-sectional wall (11) by means of a vertical tear line where it is also the hinge (not shown) or cross-sectional flexible line of the top edge of the cross-sectional wall that allows the movement of turn of the tab; additionally is shown the pair of rims (8) that work like elements of retention or top stops when the tab is in open position. The circular skirt protects against tearing by due to a side stress to the tab and forces that can operate only under effort in the vertical direction or make movement only in this direction. The tab in turn is provided by a vertical lower wall (7*a*) which lower edge is attached monolithically to the top edge of the exit or pouring orifice (not shown) in a flat horizontal surface (not shown).

Figure 3:
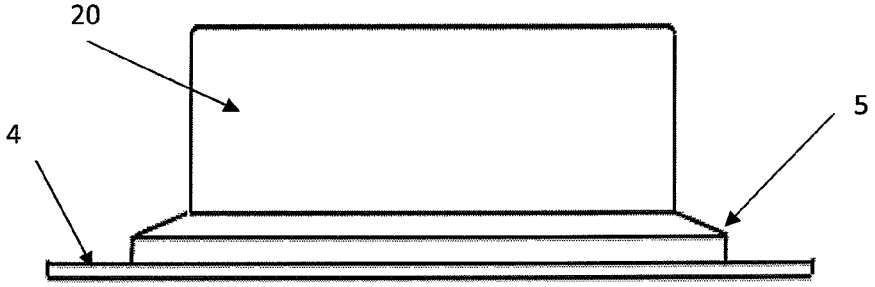
FIG. 3, is a back view of the one-piece lid for carton packages of the present application.

FIG. 3, shows to a back side view of the closure of the present invention, emphasizing the flat base (4), the step (5) and the skirt (20) of circular sidewall.

Figure 4:
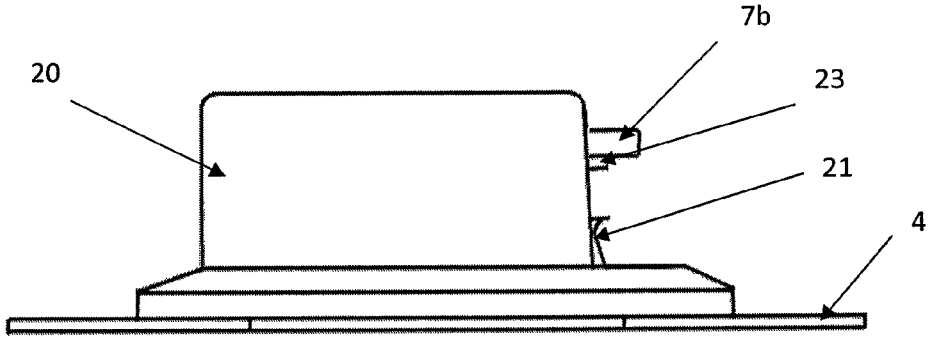
FIG. 4, is a side view of the one-piece lid for carton packages of the present application.

FIG. 4, shows a side view of the closure set of the present invention, the semicircular sidewall of the skirt (20) that does not extend all along of the diameter allowing that a frontal section (7*b*) to protrudes the tab, the tab stop (23) and the pouring frontal wall (21) with the intention of allowing and facilitating the frontal entrance of the finger of the user to manipulate the tab in the continuous opening and closing process and to place the tab in the opened assembly position or closed position, subsequent to the initial opening of the tab.

Figure 5:
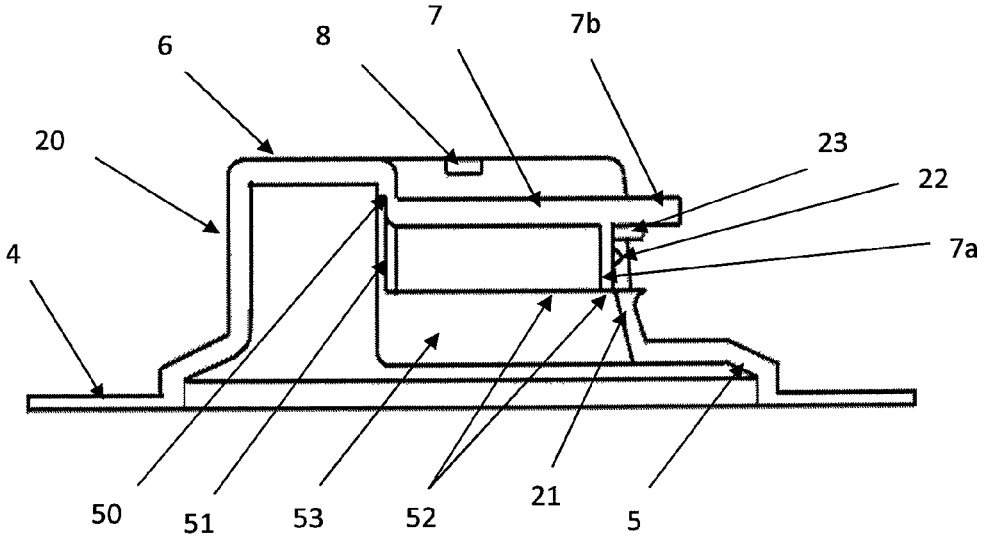
FIG. 5, is a top view of the one-piece lid for carton packages of the present application.

FIG. 5, shows a cut side view in cut to describe in a more clear way the component elements of the closure of the present invention and layout thereof; mainly the relation of the tearing lines between the pouring orifice and the tab. The hinge in the top edge of the cross-sectional wall elements involved in the process of initial opening is shown, in which pressure is exerted (to press) on the tab in the vertical direction to fracture the horizontal and vertical tearing lines, once fractured the tab rises until surpassing the rims (8) that maintain it retained in the open position. In effect, the tab (7) that is protected by the skirt (20) and the superior flat surface (6) is attached by means of a line or membrane of vertical tearing line (51) and by a line or membrane of horizontal tearing line (52) to the cross-sectional wall and the pouring orifice respectively. Underneath the tab, an empty space or pouring duct (53) is formed freely attached with the exit orifice of the carton package; also the tab (7) is placed attached to the back cross-sectional wall by means of a hinge (50) or tab hinge that allows it to turn in the vertical direction to make the function of opening and closing thereof.

The movement generated by the push of the user's finger pressed in the front end (7*b*) of the tab and to limit the turning movement as far as the displacement that the tab stop (23) has, the stop (22) both located in the frontal wall (7*a*), additionally the top of opening or flange maintains the tab in the position of maximum opening. In the frontal section of the closure of the present invention, a section of the flat base is located (4) in radial continuation towards the center a step (5) that defines a ring within which is a pouring frontal wall (21) which avoids spills by fracture and whose top edge defines a horizontal flat section where is located the pouring orifice of the closure of the present application.

Figure 6:
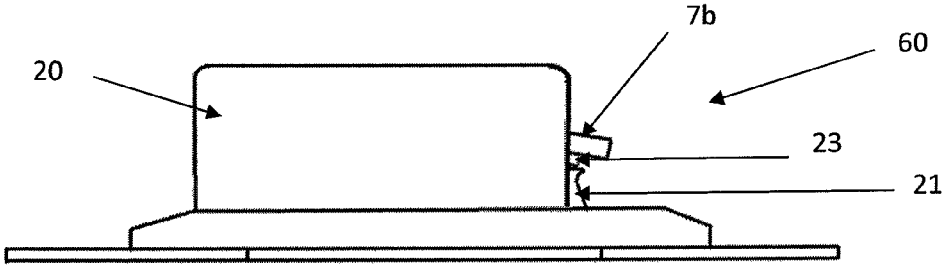
FIG. 6, is a side view of the initial process of opening the one-piece lid for carton packages of the present application.

FIG. 6, shows a side view (60) of the initial process of opening in which the tab is involved. Shown is the frontal section (7*b*) protected by the circular skirt, the frontal section (7*b*) of the tab is slightly inclined, in fact until the tab stop (23) rests on the top edge of the provided pouring frontal wall (21), this stop prevents that the tab moves more down, the inclination is sufficient to fracture membranes of union of the tab with the edge of the pouring orifice.

Figure 7:
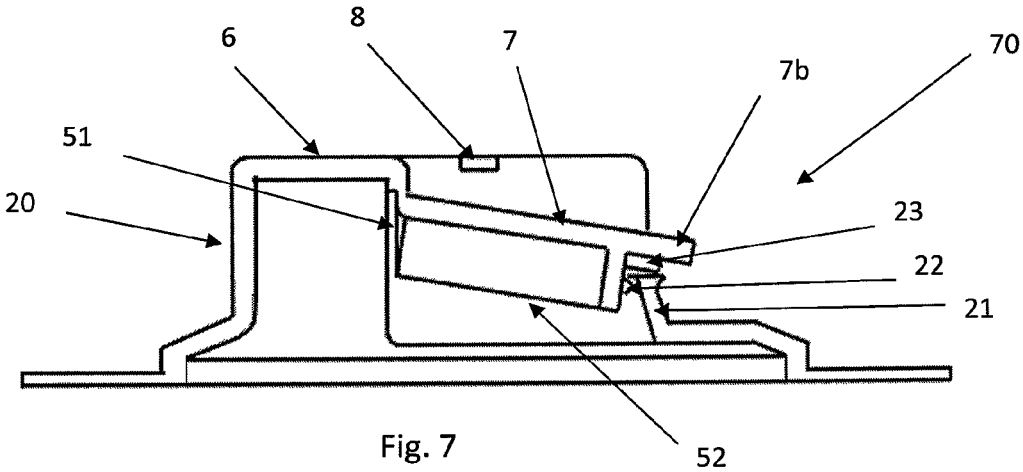
FIG. 7, is a partial side view of the initial process of opening the one-piece lid for carton packages of the present application.

FIG. 7, shows a side cut (70) of the initial process of opening in which there is final position of the tab after the rupture of the lines or membranes. The tab (7) is shown together with the top edge of the vertical wall in continuation of the surface flat (6) and limited by the skirt (20); when exerting pressure downwards on the flat surface of the tab, vertical tearing lines (51) and the horizontal tearing lines (52) are broken to allow the tab to be introduced in the pouring orifice until the tab stop (23) rests on the top edge of the frontal wall (21) and the stop (22) are completely within the frontal wall of assortment. When the tab is in this position, it has completed the rupture of the lines to allow the opening of the tab and to turn it until it is retained by the rims (8) that force it to remain in state of complete opening if it is not forced by the user to return to the closure position.

Figure 8:
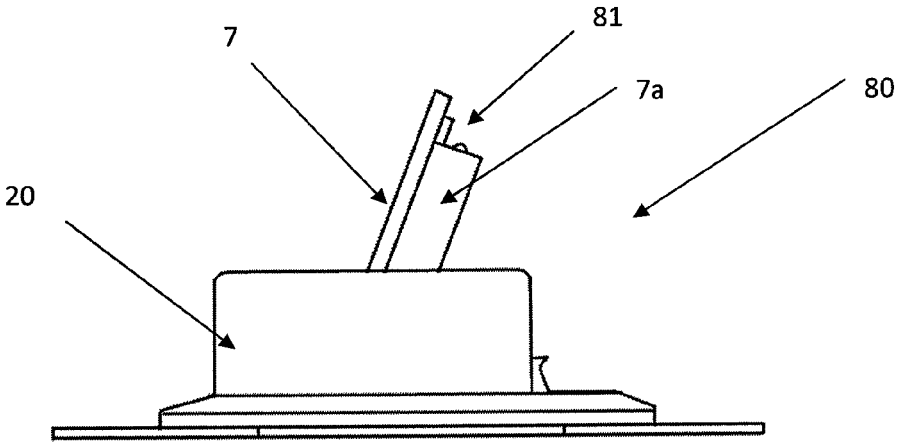
FIG. 8, is a side view of the one-piece lid for carton packages of the present application.

FIG. 8, shows a side view (80) of the closure of the present application in a complete open position (81), in which the skirt (20) protects to the tab against side stresses, the tab (7) shows the elements like the vertical sidewall (7*a*) that extends from a top flat surface, the tab is retained by the retention rims (not shown) that allows it to keep the open position for pouring without the tab obstructing.

Figure 9:
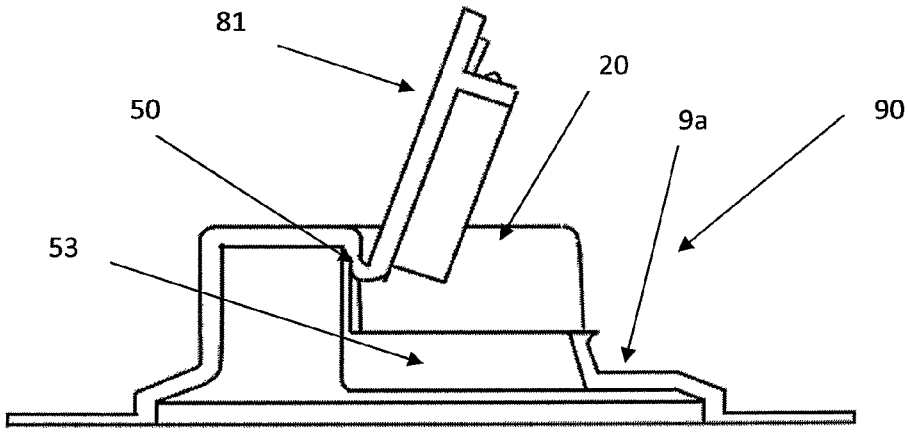
FIG. 9, is a partial top view of the one-piece lid for carton packages of the present application.

FIG. 9, shows a partial side view (90) of the closure in complete tab open position (81) where the hinge (50) allows to reach said position and it stays due to the retention flange that is not shown and that is in the top edge of the vertical wall of the skirt (20); the horizontal flat surface (9*a*) that defines the pouring orifice separates the empty space of pouring duct (53) by which circulates the content of the carton package to which is attached the closure of the present application.

Figure 10:
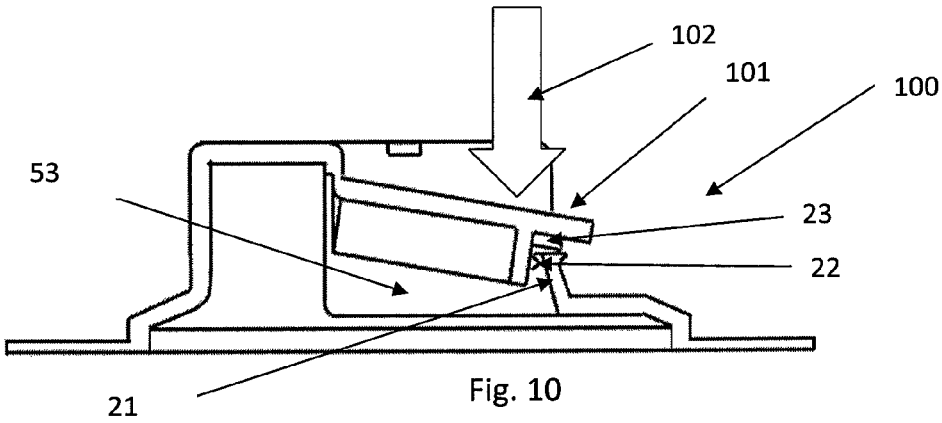
FIG. 10, is a partial side view of the closing process after the initial opening of the closure of the present application.

FIG. 10, shows a partial side view (100) of the tab in the closure position (101) after the initial opening, this position provides a nonhermetic closure that avoids the deliberate spill of the contents of the container, the tab is pressed by means of force (102) exerted by the user's finger, such force is enough to overcome the internal border of the pouring front wall (21) and allows the passage of the stop (22) keeping the tab in a closure position by making contact with the internal border of the pouring front wall and avoiding deliberate spill of the contents of the carton package. To open the closure, it is necessary to exert a contrary force by means of the finger of the user to overcome the stop and raise the tab to allow passage of the contents of the container through the pouring orifice.

Figure 11:
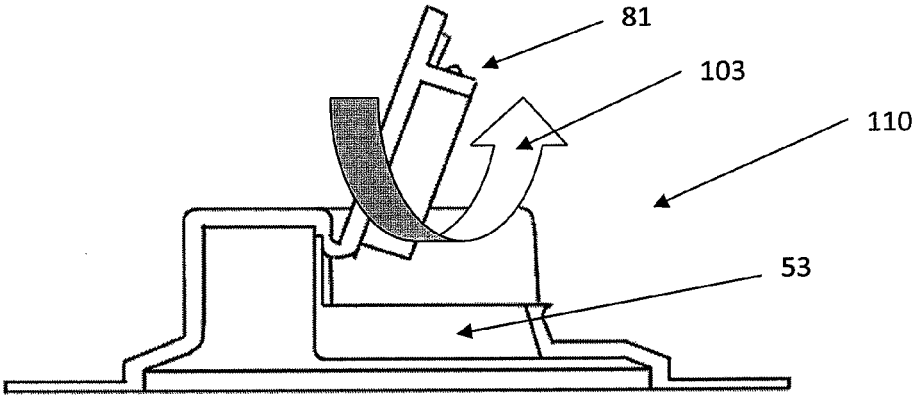
FIG. 11, is a partial side view of the opening process after initial tearing of the lid membranes or webs of the present application.

FIG. 11 is a cut or partial side view (110) that shows the tab in full open position (81) after being turned in the direction (103) to free the pouring orifice and its contents may flow through the pouring space or duct (53) to empty the inside contents of the carton package.

Figure 12:
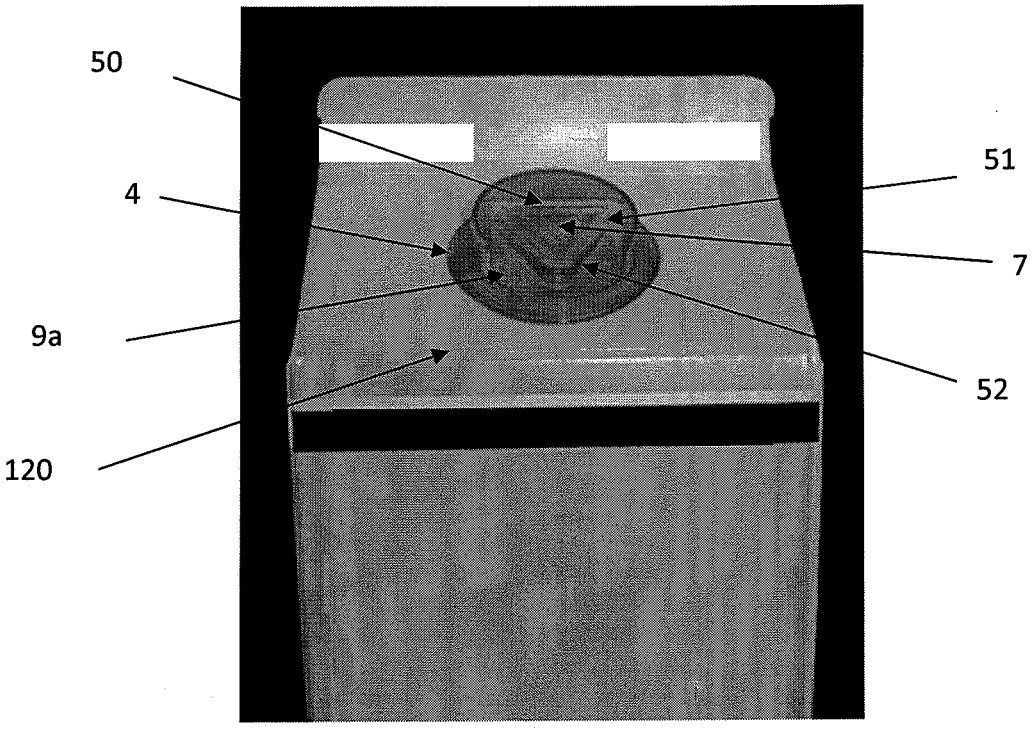
FIG. 12, is a front view that locates the position of the one-piece lid in the carton package.

FIG. 12 shows a front view of a carton package provided with a closure of the present application, such closure is located just matching the pouring orifice of the container (120), featuring the tab (7) with the vertical tearing lines (51), the horizontal tearing line (52), the hinge (50) and the horizontal flat surface (9*a*) defining the closure pouring orifice located at a top level regarding the flat base (4) in which the closure is locked to the plane of the carton package.

The invention claimed is: ,

1. A one-piece lid for a cardboard based carton with a tab adapted to be placed in a pouring opening of the cardboard based carton, comprising:

a semicircular flat base divided in two circular sections and two diametrically opposed parallel straight sections, the semicircular flat base is locked to the cardboard based carton by means of an induction process;

a circumferential step with a smaller diameter than that of the semicircular flat base;

a semicircular skirt, with a smaller diameter than that of the circumferential step and working as a protection wall of the tab, with a back horizontal flat surface and defining a front compartment with rectangular shape in which the tab is located, the front compartment formed by a horizontal flat surface with a central pouring orifice, two vertical sidewalls and one back vertical transverse wall defining the limit of the back horizontal flat surface;

the tab is joined to the central pouring orifice by a horizontal tearing line or membrane and is joined to the back vertical transverse wall by a vertical tearing line and a hinge, the tab having a triangular shape that works as a closure of the one-piece lid when the horizontal and vertical tearing lines are fractured when pressing, and the one-piece lid is provided with a continuous vertical wall occluding the central pouring orifice.

2. The one-piece lid according to claim 1, wherein the vertical sidewalls extend from a top flat surface, and the tab is retained by rims in an open position for pouring.

3. The one-piece lid according to claim 2, wherein the vertical sidewalls of a housing have a flange working as a stop to retain the tab in the open position.

4. The one-piece lid according to claim 2, wherein the semicircular skirt, housing the tab protect against deliberate side stresses.

5. The one-piece lid according to claim 2, wherein the tab has a front section with two retaining elements, the two retaining elements comprising a tab retaining stop and a closure retaining stop.

6. The one-piece lid according to claim 5, wherein the tab retaining stop makes contact with a pouring front wall.

7. The one-piece lid according to claim 5, wherein the closure retaining stop exceeds a top border of the pouring front wall to make contact with an internal border of the pouring front wall.

8. The one-piece lid according to claim 1, wherein the tab has a front protrusion by which the tab is pulled with a user's finger for opening after an initial opening of the tab.

9. The one-piece lid according to claim 1, wherein the tab has the horizontal tearing line in a top border of the central pouring orifice.

10. The one-piece lid for according to claim 1, wherein in the process of initial opening the tab is pressed to break horizontal and vertical tearing lines.

11. The one-piece lid according to claim 1, wherein to pour contents of the cardboard based carton, the tab is completely raised by turning over the hinge located on the back transverse vertical wall.

12. The one-piece lid according to claim 1, wherein the tab provides a non-hermetic closure in which a closure retaining stop is located below the horizontal tearing line.

* * * * *